United States Patent [19]

Weskamp et al.

[11] Patent Number: 4,481,011

[45] Date of Patent: Nov. 6, 1984

[54] COKE OVEN CHARGE MIXTURES WITH COAL BINDER

[75] Inventors: Wilhelm Weskamp, Wattenscheid; Wilhelm Stewen, Dortmund-Eichlinghofen, both of Fed. Rep. of Germany

[73] Assignee: Ruhrkohle Aktiengesellscaft, Essen, Fed. Rep. of Germany

[21] Appl. No.: 431,215

[22] Filed: Sep. 30, 1982

[51] Int. Cl.[3] ..... C10L 1/32

[52] U.S. Cl. ..... 44/51; 44/24; 44/61

[58] Field of Search ..... 44/51, 61, 24

[56] References Cited

U.S. PATENT DOCUMENTS

| | | | |
|---|---|---|---|
| 1,811,935 | 6/1931 | Hue | 44/24 |
| 3,232,727 | 2/1966 | Gupitill, Jr. et al. | 423/650 |

FOREIGN PATENT DOCUMENTS

| | | | |
|---|---|---|---|
| 763533 | 7/1981 | Belgium | 44/51 |
| 3022604 | 1/1982 | Fed. Rep. of Germany . | |
| 30496 | 3/1981 | Japan | 44/51 |

*Primary Examiner*—Andrew Metz
*Assistant Examiner*—Margaret B. Medley

[57] ABSTRACT

In a method of preparing coal in particulate form for charging coke ovens, the particulate coal is initially treated with a binding agent selected from carbo-pitch, residues of coal oil refining and oil refining residues; particulate coal so treated is mixed with 0.1 to 0.3% of light oil and subsequently agglomerated before feeding into coke ovens. Non-self-fluxing coal may be treated by this method and mixed with granulate self-fluxing coal to form a coke oven charge.

8 Claims, No Drawings

COKE OVEN CHARGE MIXTURES WITH COAL BINDER

FIELD OF THE INVENTION

The invention relates to the preparation of coal for use in charging coke ovens, and more particularly to preparation of particulate coal, including coal in fine grain form, to make the coal suitable for feeding as a coking oven charge.

BACKGROUND OF THE INVENTION

Coke is an indispensable ingredient of many industrial and metallurgical processes, for example, blast-furnace operations, certain smelting operations, certain chemical processes and other purification processes. In order for such processes to be refinable and economical, it is very desirable that the coke should be relatively inexpensive, of uniform predictable quality, and in a suitable prepared form.

Additionally, the need for a smokeless fuel, such as coke, which would not obnoxiously pollute controlled environments especially in the face of fluctuating oil prices, has largely been responsible for the emphasis on the development of sophisticated coke ovens which are able to economically produce high quality coke of predictable coke-characteristics such as porosity, volatile content, coherence, swelling, coke-reactivity, mechanical strength and combustibility. The aforesaid coke-characteristics are influenced in part by the control of operating conditions per se within the coke oven; also however, the coal grade as well as the nature and the extent of preparation of the coal play an equally important role.

Coke ovens are of many types; in the basic or fundamental form, a coke oven is known to be built in the form of a firebrick-chamber in a substantially hemispherical shape. Coke ovens of such type are termed "beehive coke ovens". Invariably nowadays, with minor exception, beehive coke ovens are considered old fashioned and, being somewhat wasteful, are obsolete; instead, by-product ovens are used now for many applications.

As a first step in coke-production, coal is prepared and charged into the top of empty coke ovens and levelled to a uniform layer. Almost immediately after charging, because of the heat retained in the oven from previous charges, or because of preheating, gases start evolving from the charged coal. The evolved gases start burning because of combustion-air admitted in controlled quantities. In some ovens there is a provision to collect effluent gases whereby a portion of the heat contained in the effluent gases is utilized for generating steam, through the use of waste heat boiler.

The efficiency of operation of a coke oven is usually measured by the production of good and uniform quality coke, minimum consumption of fuel gas, minimum loss of volatile products by leakage; also contributing to the efficient operation of a coke oven is the efficient performance of the heating flues within the coke oven, which performance is influenced by the heat conductivity characteristics of the coal charge; for certain vertical flue ovens, gas and preheated air are admitted at the base of the flues causing upwardly directed combustion therein in order to provide additional heat where needed. Any suitable kind of gaseous fuel can be used for combustion in a coke oven, including the coke oven gas itself, or blast furnace gas. Even-heating and proper temperature control are very crucial, and the degree of compactness of the loaded coal, as well as the size of the loaded coal particles and the preloading preparation thereof play a critical role in the production of good quality coke. The degree of compactness not only influences the bulk of the coal which can be charged into the coke oven and but also directly affects the heat transfer patterns within the coke oven.

For any given grade or category of coal, in the interest of economy, it is desirable to use coal portions of normal size which may be in the form of larger chunks and also utilize a wide range of sizes in particulate form, including fine grain portions in the coke ovens.

Loading of fine grain portions per se, of coal or inclusion of fine grain coal in the charge mixture to the coke oven, is found to result in a decrease in the bulk density of the charge mixture on the whole. A reduction of the bulk density has a threefold effect on the performance of the coke oven leaving a lot to be desired.

First and the most obvious, a lower bulk density of the charge results in a reduced capacity of the coke oven with the consequence that in a given time duration, the coke output becomes diminished compared with the production with a normal bulk-density charge.

Second and no less important, the coking time is relatively increased with low bulk density charges, because of poorer heat transfer in the coking mixture. Increased coking time obviously results in poor economy and high cost of production.

A third consequence cannot be ruled out that with low bulk density charges, caused because of fine grain portions of coal, often the useful amount of coke in the output is relatively reduced.

DESCRIPTION OF PRIOR ART

In order to obviate the aforesaid problems, coal in particulate form is known to be made into briquettes using a suitable binder and allowed to harden before feeding in with the coke oven charge. An example of such a briquetting process can be found in German Pat. No. P 30 22 604.1, which teaches effectively using grades of coals known in the art as self-fluxing coals.

German patent specification No. P 30 22 604.1 teaches the preparation of a coke oven charge mixture which involves the separate grinding of a self-fluxing coal and of a selected non-self-fluxing coal with the latter being preheated, mixed with a suitable binder and briquetted. Following briquetting of non-self-fluxing coal portions, the self-fluxing coke portion is mixed with the briquettes to form the coke oven charge. Suitable binders taught in the German patent for forming the non-self-fluxing coal briquettes include carbo-pitched residues of coal oil refining and oil refinery residues. While the resultant charge mixtures produced with the method of said prior art German patent give fairly satisfactory results partly regarding the heat transfer aspect of the coke oven operation, there are however some attendant disadvantages.

It is impractical for a briquetting plant to be geared to producing a complete range of assorted sizes of briquettes; with a limited choice of the briquette size which is usually chosen to be compatible with the general size range of the chunks in the coal charge, the resultant space factor of the briquettes is not very high, again resulting in poor heat transfer, consequent more than average coking time, and low coke production.

An added disadvantage of using briquettes is a high shrinkage rate, up to as much as 15%, leading consequently to high gas collection and temperatures. Also, other problems like storage and transportation of briquettes after they are formed are to be solved when briquettes are used.

To obviate the above problems in the present invention, agglomeration of fine grain coal, after treating the same in a specific manner, has been employed so as to largely obviate undesirable shrinkage and other problems encountered with the prior art methods which include the use of briquettes in the coke oven charge.

SUMMARY OF THE INVENTION

According to the present invention, fine grain coal in the coke oven charge is pretreated by the addition of a binding agent and then treated with light fuel oil in a specific manner hereinafter described in detail; fine grain coal so treated is agglomerated and charged into the coke oven; such process results in lubricating the coal particles which facilitates agglomeration in such manner as to obviate potential problems caused by low bulk density.

In a preferred embodiment described hereinafter, light fuel oil, preferably 0.1 to 0.3% by weight, is applied, in the form of a spray, to fine grain coal particles after the particles are first treated with a predetermined binder. The resulting particles are subjected to agglomeration which results in larger agglomerated chunks of coal which for all practical purposes react and perform similar to the original larger chunks of coal from the points of view of bulk density, space factor and heat transference characteristics.

For a more complete understanding of the invention and the features and advantages thereof, reference may be had to the following detailed description wherein a preferred embodiment of the invention is described.

DETAILED DESCRIPTION OF PREFERRED EMBODIMENT

In the preparation of a coke oven charge according to the present invention, a coal may first be only partly processed in accordance with the teachings of the above-mentioned German patent specification No. P 30 22 604.1. A non-self-fluxing coal in fine particulate form is mixed with a binder such as carbo-pitch, residues of coal oil refining or oil refinery residues. Preferably, the binder has a softening point temperature equal to or greater than 90° C. The binder is heated to a temperature of 200°-220° C., atomized and sprayed onto the ground coal, preferably while the coal is in a free-falling stream. The heating temperature of 200°-220° C. may be modified depending on the softening point temperature of the binding agent.

Following the application of the binder to the particulate coal, a light fuel oil is added to the mixture. Preferably, the oil is atomized and sprayed onto a free-falling coal stream. A preferred quantity of light fuel oil is in the range of 0.1 to 0.3% by weight. It is theorized that the oil functions as a lubricant for the fine coal particles.

Following the addition of the light fuel oil, the coal particles are agglomerated to form granules which are mixed with self-fluxing coals to form a coke oven charge. The coal binder is so chosen that softening point temperature of the coal binder assures that the mixture can easily be conveyed and retrieved from bunkers.

"Self-fluxing coal" is a term known in the art, which implies that the ratio of acid component to base component in the coal composition is such that there is no need for any flux-additive to form a suitable coal slag or sinter. Both self-fluxing coals and non-self-fluxing coals are referred to in this specification.

The mechanical arrangements, contrivances and the apparatus per se which can be used in the method or process steps of the invention, are not described herein as they are not part of the invention and may be found by one skilled in the art form available publications and literature. For instance, if there is need to size the non-self-fluxing coal initially by grinding, the means to grind the non-self-fluxing coal may be any commercial grinding means which is suitable for the purpose. The atomizer and sprayer for the binder may be chosen from any commercially available units which are suitable chemically and otherwise for handling carbo-pitch and coal oil oil refinery residues. Atomized jets spraying the binding agent onto free falling fine sized particulate coal may be located at the sides of a container wherein particulate coal is admitted from the top for controlled free-falling. Likewise, the means for agglomerating particulate coal after application with binding agent and light fuel oil may be any commercially available or described unit so long as it has the required capabilities. Agglomeration of particles is a well known technique in the art and is resorted to to facilitate several process steps including, for example, separating ash and similar particulate products of combustion.

Examples of agglomeration of particles can be found in published literature such as, for example, German Offenlegungschrift No. P 28 28 562.3 entitled "Slag Removal" and published in December 1980, and also in U.S. Pat. No. 3,232,727 to Guptil, published Feb. 1, 1966 and entitled "Synthesis Gas Generator".

The process described above discloses a method for pretreating fine sized particulate coal to prepare the same for a charge mixture into a coke oven whereby problems such as low bulk density, poor heat transference, long coking time and low coke production are all overcome.

While only a preferred embodiment of the invention has been described hereinabove, the invention is not to be taken as limited to all of the details thereof, as modifications and variations thereof may be made without departing from the spirit or scope of the invention.

What is claimed is:

1. A processs of preparing a coal mixture utilizing coal in a fine grain particulate form for charging into a coke oven, comprising the steps of:

mixing the coal with a binding agent selected from the group consisting of carbo pitch, residues of coal oil refining, and oil refining residues, to produce a mixture, adding 0.1-0.3% by weight of light fuel oil to said mixture of coal and binder, effecting said light fuel oil addition to the coal and binder mixture by atomization of the oil into a free-falling stream of the mixture, and causing agglomeration of said mixture.

2. The process of claim 1 including the step of preheating the binding agent to a temperature in the range of 200°-220° C. before mixing the fine grain coal with the binding agent.

3. The process of claim 2 wherein the step of mixing the binding agent comprises atomizing the binder and spraying the atomized binder onto the fine grain coal from the sides of a container wherein fine grain coal is admitted at the top of the container for controlled free-fall.

4. In a coke oven charge mixture including fine grain coal and a binding agent selected from a group comprising carbo-pitch, residues of coal oil refining, and oil refinery residues, the improvement wherein said charge mixture further includes 0.1–0.3% by weight light fuel oil.

5. A method of preparing fine grain coal for charging a coke oven, said fine grain coal being composed of separate non-self-fluxing and self-fluxing coal compositions, said method comprising mixing non-self-fluxing fine grain coal with a binding agent selected from the group consisting of carbo-pitch, residues of coal oil refining and oil refinery residues to produce a mixture;

adding to said mixture 0.1 to 0.3% by weight of a light fuel oil, adding said light fuel oil by atomizing the fuel oil to interact with and wet the coal particles which have been treated with the binding agent, causing agglomeration of said mixture and added light fuel oil to form granules; and adding self-fluxing coals to said granules to form a coke oven charge.

6. The method as in claim 5 including the step of preheating the binding agent to a temperature of 200°–220° C. before applying the binding agent to the non-self-fluxing coal particles.

7. The method as in claim 6 wherein the step of applying the binding agent to the coal particles comprises atomizing the binding agent onto a free-falling stream of coal particles.

8. The method as in claim 6 including the step of adjusting the preheating temperature of the binding agent, depending on the softening point temperature of the binding agent.

* * * * *